United States Patent [19]

Kitchen

[11] Patent Number: 4,832,598

[45] Date of Patent: May 23, 1989

[54] PULSE COMBUSTION APPARATUS

[75] Inventor: John A. Kitchen, Ontario, Canada

[73] Assignee: John A. Kitchen Ltd., Hastings, Canada

[21] Appl. No.: 190,740

[22] Filed: Apr. 22, 1988

[51] Int. Cl.[4] ..... F27B 15/00

[52] U.S. Cl. ..... 432/103; 432/58; 432/105; 431/1

[58] Field of Search ..... 432/58, 106, 103, 105, 432/109; 431/1

[56] References Cited

U.S. PATENT DOCUMENTS

| | | | |
|---|---|---|---|
| 2,619,776 | 12/1952 | Potters | 432/13 |
| 4,082,498 | 4/1978 | Offergeld et al. | 432/58 |
| 4,526,535 | 7/1985 | Wunderlich | 432/105 |
| 4,624,635 | 11/1986 | Givay et al. | 432/58 |
| 4,637,794 | 1/1987 | Gray et al. | 432/58 |
| 4,695,249 | 9/1987 | Gray | 432/58 |
| 4,701,126 | 10/1987 | Gray et al. | 432/58 |
| 4,770,626 | 9/1988 | Zinn et al. | 432/58 |

*Primary Examiner*—Henry C. Yuen

*Attorney, Agent, or Firm*—Rogers, Bereskin & Parr

[57] ABSTRACT

A pulse combustion dehydration apparatus includes a pulse combustor designed to operate with a low pressure fuel gas supply and having valve means to stop the supply of gas to the combustion chamber during high pressure portions of the pulse combustion cycle. Gas enters the combustion chamber through a fuel distributor having a series of radial gas outlets downstream of an annular flame trap through which combustion air is admitted to the combustion chamber from an air cushion chamber. These features increase the amplitude of the combustion cycle and reduce the amount of residual flame in the combustion chamber, resulting in a strong cycle. An air bypass pipe from the air cushion chamber to the exhaust pipe apparently increases the compression in the combustion chamber from the returning pressure waves. The deydration apparatus further includes a rotary drum into which material is to be dehydrated is delivered in the exhaust gas stream from the exhaust pipe of the pulse combustor. Material collected at the inlet end of the drum is delivered through a vertical lift pipe into a cyclone separator.

8 Claims, 2 Drawing Sheets

PULSE COMBUSTION APPARATUS

FIELD OF THE INVENTION

This invention relates generally to pulse combustion apparatus and is concerned more particularly (but not exclusively) with an apparatus suitable for use in material processing (e.g. dehydration). The term "pulse (or pulsating) combustor" is often used interchangeably with "pulse combustion apparatus".

BACKGROUND OF THE INVENTION

Pulsating combustion is a phenomenon which is well known in the art of air and water heating and is quite extensively discussed in the literature. Examples of patents that have issued in this field are U.S. Pat. Nos. 2,916,032; 3,267,985; 4,241,720; 4,241,723 and 4,309,977 (all to Kitchen). Proposals have also been made to use pulse combustors for material processing. For example, U.S. Pat. No. 4,706,390 (Kitchen) discloses a pulse combustion dehydrator. Other examples of pulse combustion dehydrators are shown in Lockwood's U.S. Pat. Nos. 3,462,955 and 3,618,655. A method and apparatus for conducting a process in a pulsating environment is disclosed in Zinn et al.—U.S. Pat. No. 4,699,588.

Early examples of prior art pulse combustion apparatus are shown in U.S. Pat. Nos. 2,898,978 (Kitchen) and 3,005,485 (Salgo and Kitchen).

Pulsate combustors employed for material processing such a dehydration are unlike those used for heating in that they are required to operate with a strong combustion cycle. This strong cycle is necessary for the production of intense pressure waves, which accelerate the material processing. For example, increasing the rate of drying by imposing sound waves on a material to be dried in the presence of heated air is discussed in "Sonic Drying" by Robert S. Soloff (The Journal of the Acoustical Society of America—Volume 36, No. 5, May 1964).

U.S. Pat. No. 4,697,358 (Kitchen) discloses a pulsating combustor in which a specially designed gas distributor is located downstream of a flame trap. When the combustor is in operation, gas flows virtually continuously into the combustion chamber from a high pressure gas supply. It was found in practice that this design resulted in improved starting of the combustor and a stronger cycle as compared with prior art designs. This combustor was found well suited to use in a pulse combustion dehydrator.

With this background, an object of the present invention is to provide improvements in pulse combustion apparatus primarily (but not exclusively) for use in material processing.

The apparatus provided by the invention includes a combustion chamber having inlet means for fuel charges and an outlet for exhaust gases remote from the inlet means. An exhaust pipe (sometimes called a "tail pipe") extends from the exhaust gas outlet and forms a reasonant system with the combustion chamber. The apparatus also includes means operable to initiate combustion in the chamber. In accordance with the invention, the apparatus further includes low pressure fuel gas supply means including a gas cushion chamber having an inlet provided with a metering orifice and an outlet. The fuel charge inlet means of the apparatus includes a fuel gas distributor disposed within the combustion chamber and defining an annular combustion air passageway around the distributor. The distributor has a fuel inlet connected to the outlet of the gas cushion chamber and a plurality of discrete fuel gas outlets from which individual gas streams issue into the combustion chamber when the apparatus is in operation. Pressure responsive valve means is provided for controlling communication between the fuel inlet and the gas outlets so and is arranged to interrupt the flow of gas to the outlets during high pressure portions of the pulse combustion cycle. Pressure responsive valve means is also provided for admitting air to the annular combustion air passageway during low pressure portions of the pulse combustion cycle. An annular flame trap extends across the combustion air passageway upstream of the fuel gas outlets of the distributor and the flame trap is adapted to provide a relatively smooth unturbulated flow of air into the combustion chamber.

The invention is based on the discovery that some increase in the amplitude of the combustion cycle (and hence a stronger cycle) will result from the use of low pressure gas with valving to stop the gas during high pressure portions of the pulse combustion cycle. This action is believed to reduce the amount of residual flame in the combustion chamber which persists during low pressure portions of the cycle. The use of an annular flame trap providing a relatively smooth, unturbulated flow of air also helps to reduce the residual flame. It is believed that residual flame is necessary for ignition of successive fuel charges after initial starting of the pulse combustion process but that residual flame should be kept to a minimum when a strong cycle is required.

Preferably, the exhaust pipe of the apparatus includes an inner portion adjacent the combustion chamber of a first diameter and an outer portion adjacent said inner portion of increased diameter. A fluid inlet is then provided in the outer portion of the exhaust pipe at a location adjacent the inner portion for permitting a fluid to be drawn into the pipe by pressure waves returning to the combustion chamber during low pressure portions of the pulse combustion cycle and venturi action due to the increase in diameter of the exhaust pipe. In a material processing application, a fluid appropriate to the particular process may be permitted to enter the exhaust pipe through the fluid inlet. Alternatively, the fluid may be air. Preferably, the fluid inlet is provided with a pipe through which the fluid enters the exhaust pipe.

In an apparatus which includes a cushion chamber for combustion air communicating with the combustion chamber inlet means, the pipe may be an air bypass pipe extending between the air cushion chamber and the fluid inlet in the exhaust pipe. As compared to an open pipe, this arrangement has the advantage that the air cushion chamber provides a noise muffling effect.

It has been found that the combustion cycle is strengthened by the use of an air bypass pipe and that the addition of low temperature (higher density) air to the exhaust at the location referred to above apparently increases the compression in the combustion chamber produced by the returning pressure waves. In a material processing application, material can be introduced into the exhaust pipe through the bypass pipe since there is considerable suction in the pipe. In other words, the bypass pipe can also serve as a material inlet. This may be additional to or instead of a special material inlet at the same location in the exhaust pipe.

The invention also provides a dehydrator including a pulse combustor having a combustion chamber and an elongate exhaust pipe forming a reasonant system with the combustion chamber, the exhaust pipe having an inlet for material to be dehydrated and an outlet through which the material is discharged in a pulsating exhaust gas stream when the combustor is in operation. The dehydrator also includes a motor driven rotary drum having a first end into which the exhaust pipe of the pulse combustor extends, and a closed second end. The drum extends about a rotary axis and is positioned with its said axis inclined upwardly towards the said closed end so that material introduced into the drum from the exhaust pipe is directed towards said closed end but tends to return towards the first end of the drum under the effect of gravity. The drum is provided internally with mechanical means for assisting return of the material towards the first end of the drum and the drum has a material outlet at its first end. The dehydrator further includes a cyclone separator having a cyclone chamber provided with an inlet for receiving a gas stream containing suspended material and in which said stream and material are separated. A dried material outlet is provided at a lower end of the chamber and the separator also has a gas stream outlet. The material inlet of the cyclone chamber is positioned above the material outlet of the rotary drum and the two are connected by duct means extending upwardly from the material outlet to the cyclone chamber inlet.

BRIEF DESCRIPTION OF THE DRAWINGS

In order that the invention may be more clearly understood, reference will now be made to the accompanying drawings which illustrate a preferred embodiment of the invention by way of example, and in which.

DESCRIPTION OF THE PREFERRED EMBODIMENT

Figure 1:
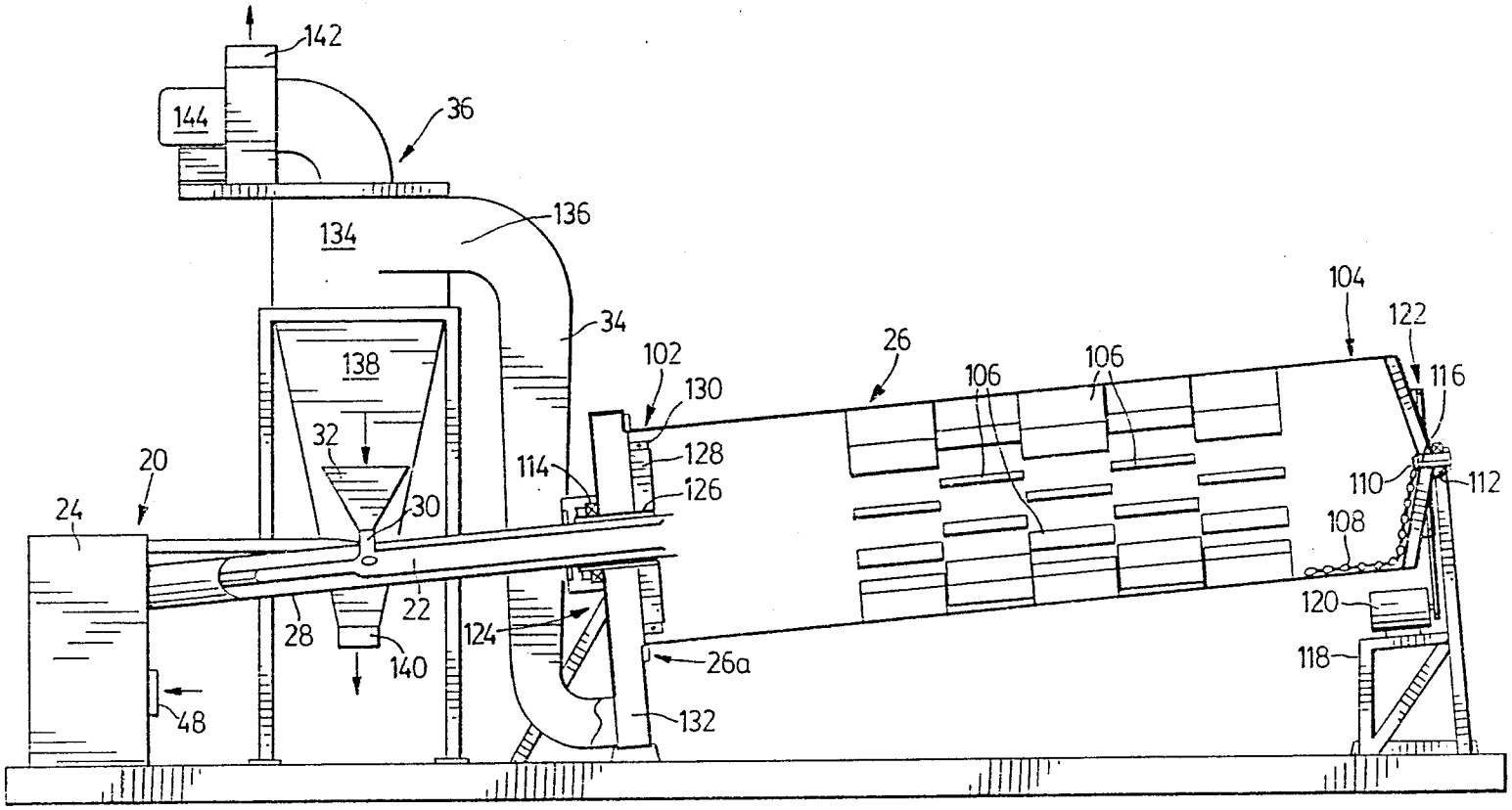
FIG. 1 is a diagrammatic illustration, partly in section, of a pulse combustion dehydrator in accordance with a preferred embodiment of the invention; and, FIG. 2 is a vertical sectional view through the pulse combustor of the dehydrator shown in FIG. 1.

Referring first to FIG. 1, reference numeral 20 generally denotes a pulse combustion apparatus and numeral 22 indicates an exhaust or tail pipe of the apparatus which extends from a housing 24 to a motor driven rotary drum 26. A shroud 28 encloses the exhaust pipe 22. Material to be dehydrated is delivered into the exhaust pipe through a material inlet 30 from a hopper 32. As will be described in more detail later, the material is carried into the drum 26 by the pulsating gas stream of the pulse combustor. A material outlet from the drum is generally indicated at 26*a* and communicates with a vertical lift duct 34 which communicates with an inlet to a cyclone separator 36.

Figure 2:
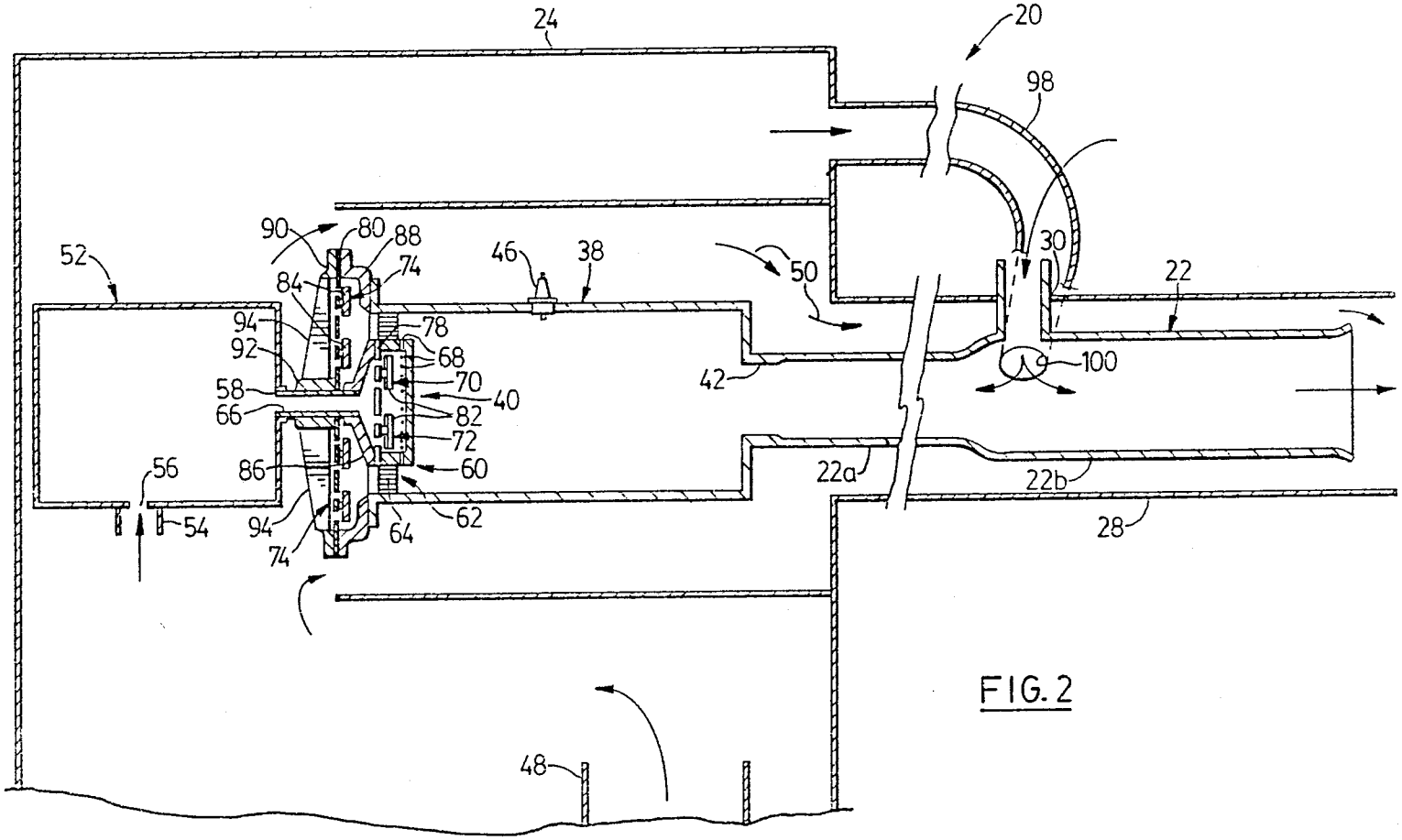

Referring now to FIG. 2, the pulse combustion apparatus 20 includes a combustion chamber 38 which is of cylindrical shape and which has at one end fuel charge inlet means, generally denoted by reference numeral 40 and, at the other end, an outlet 42 for exhaust gases. Exhaust pipe 22 extends from the exhaust gas outlet 42 of the combustion chamber and forms a reasonant system with that chamber. The combustion chamber is provided with a spark plug 46 for initiating combustion in the chamber. Once initiated, combustion is self-sustaining as is well-known in the art. Electrical supply equipment for the spark plug 46 has not been shown since it will be entirely conventional.

The housing 24 shown in FIG. 1 encloses combustion chamber 38 and forms what is known as an "air cushion chamber" around the combustion chamber, from which the combustion chamber draws its combustion air. An air inlet to the chamber is indicated at 48. Shroud 28 extends from an opening in that chamber and encloses the exhaust pipe 22. Combustion air entering the air cushion chamber also flows around and cools the exhaust pipe as indicated by the arrows denoted 50.

In accordance with the invention, the pulse combustion apparatus is provided with a low pressure fuel gas supply including a gas cushion chamber 52 within housing 20. Chamber 52 has an inlet 54 provided with a metering orifice 56, and an outlet 58. A pipe (not shown) from an external low pressure gas supply is connected to inlet 54 in service.

The metering orifice 56 limits the gas flow for the required heat input, as well as eliminating the effect of reasonance which would otherwise occur in the gas supply piping. The volume of chamber 52 for the type of apparatus referred to should be no less than about 1 cubic inch for each 2,500 BTU/hr of fuel input.

The term "low pressure" as used in this application to refer to the gas supply is well understood in the art but for the sake of clarity is intended to mean a low pressure of up to about 6 inches water gauge pressure. In practice, the gas pressure within chamber 52 is likely to be about 1 to 2 inches water gauge.

The fuel charge inlet means 40 within the combustion chamber includes a fuel gas distributor 60 which is of cylindrical shape and is positioned coaxially with the axis of the combustion chamber 38. The distributor is of smaller diameter than the internal diameter of the chamber so that an annular combustion air passageway 62 is defined around the distributor. This passageway receives an annular flame trap 64. The flame trap is made up of alternate layers of flat and corrugated sheet metal strips respectively that are wound around distributor 60 with the corrugations extending axially of the combustion chamber. A flame trap of this type is described in the Kitchen U.S. Pat. No. 4,697,358 discussed previously, the disclosure of which is incorporated herein by reference. The flame trap serves as a "straightener" for combustion air entering the combustion chamber and protects against blow-back and radiated heat from the combustion chamber.

Fuel distributor 60 has a fuel inlet pipe 66 which is connected to the fuel outlet 58 of the gas cushion chamber 52, and a plurality of discrete fuel gas outlets 68 which open into the cylindrical surface of the distributor and from which individual gas streams issue into the combustion chamber when the apparatus is in operation. Twenty equally spaced fuel gas outlets are believed to represent the optimum on a four inch diameter gas distributor.

Two pressure-responsive valves 70 and 72 control communication between the fuel inlets 66 and the gas outlets 68 and operate to interrupt the flow of gas to the outlets during high pressure portions of the pulse combustion cycle. A series of similar valves, individually denoted 74, control admission of combustion air to the combustion chamber and, likewise, stop air admission during high pressure portions of the cycle. The valves 70, 72 and 74 are of the form disclosed in U.S. Pat. No. 4,640,674 (Kitchen) the disclosure of which is herein incorporated by reference. Essentially, each valve is a diaphragm valve and comprises a diaphragm that is free to float under the influence of changing pressure conditions with the combustion chamber between a valve plate and a valve retainer spaced from the plate. The valve plate for valve 70 and 72 is denoted 78 while the corresponding plate for valve 74 is denoted 80. Valve retainers spaced from the respective plates are indicated at 82 and 84. During high pressure portions of the pulse combustion cycle, the diaphragms located between the respective retainers and plates are forced to the left as shown in FIG. 1, closing openings in the respective valve plates, while the diaphragms are drawn to the right during low pressure portions of the cycle to allow gas or air as the case may be to enter through those openings.

In the illustrated embodiment, the valve plate 78 for the gas valves is in effect trapped between the main body of the gas distributor 60 and a housing 86 extending between the main body and the inlet pipe 66, while the valve plate 80 for the air valves is trapped between corresponding housing parts denoted 88 and 90 respectively upstream of combustion air passageway 62. Housing part 90 includes a central hub 92 and a series of spaced arms 94 which radiate outwardly from the hub and between which air can flow to the valve 74.

The exhaust pipe 22 is cylindrical in shape and includes an inner portion **22*a* of a first diameter and an outer portion 22*b* of increased diameter. The inlet 30 for material to be dehydrated and the inlet is disposed in the outer portion 22*b* of the exhaust pipe downstream of its junction with the inner portion 22*a*. The injector action in the vicinity of the material inlet that occurs due to the differing diameters of the respective portions of the exhaust pipe tends to draw material into the exhaust pipe through inlet 30**.

An air bypass pipe 98 is connected into the exhaust pipe at essentially the same axial location along the pipe as material inlet 30. Pipe 98 extends between an opening 100 in the wall of the exhaust pipe and an opening in the housing 24 forming the gas cushion chamber. This allows low temperature (high density) air to be drawn into the exhaust pipe. As discussed previously, this has been found to apparently increase the compression in the combustion chamber that occurs due to the returning pressure waves in the exhaust pipe during low pressure portions of the cycle Preferably, the opening 100 should be located approximately at the centre of the length of the exhaust pipe and the bypass pipe 98 should be of a length approximately equal to the distance between opening 100 and the combustion chamber. While the specific dimensions are not believed to be critical, a typical example of the dimensions of the exhaust pipe would be: overall length—7 feet, inside diameter at the outer end—3 inches, inside diameter at the inner end (at the combustion chamber)—2 inches. It is believed that opening 100 should be less than this latter dimension and may be of the order of 1½ inches.

Pipe 98 need not be connected to the air cushion chamber although excessive noise may result if this connection is not made. Depending on the nature of the material processing operation being performed, it may be beneficial to admit a fluid other than air through opening 100.

As indicated previously, the particular form of pulse combustor apparatus provided by the invention has been found to provide improvements in terms of cycle strength as compared with conventional apparatus. Specifically, it has been found that some increase in the amplitude of the combustion cycle will result from the use of low pressure gas with valving to stop the gas during the positive pressure part of the cycle. This action reduces the amount of residual flame in the combustion chamber which persists during the negative part of the cycle. The flame trap 64 also helps to reduce the residual flame. These effects combined with the benefits discussed above derived from the use of air bypass 98 provide particular benefits in a pulse combustor intended to be used in material processing. It should, however, be noted that the invention is not limited to material processing applications and may also be beneficial in other forms of pulse combustion apparatus.

Referring back to FIG. 1, the remainder of the dehydrator will now be described in more detail. It will be remembered that material to be dehydrated is introduced into the exhaust pipe 22 of the pulse combustor and is discharged from the exhaust pipe in a pulsating gas stream into the motor driven rotary drum 26. Drum 26 is cylindrical in shape and extends about a rotational axis indicated at X in FIG. 1. Exhaust pipe 22 extends into a first end 102 of the drum and the drum has a second, closed end 104. The drum is supported with its axis inclined upwardly towards the closed end 104 so that material introduced into the drum from the exhaust pipe is directed towards the closed end but tends to return towards the first end 102 of the drum under the effect of gravity. Also, the drum is provided internally with mechanical means for assisting the return of the material, in the form of a series of flights generally indicated at 106 that repeatedly lift and drop the material through the jet emanating from the exhaust pipe 22. A chain 108 is secured at one end 110 to the closed end of the drum and hangs free so that, as the drum rotates, the chain exerts a wiping action, preventing material accumulating near the closed end of the drum.

In summary, when the pulse combustor is in operation, the material introduced into the exhaust pipe is broken up by the action of the gases in that pipe and discharged at high velocity towards the closed end of the drum. Chain 108 prevents material collecting at that end and the flights agitate the material so that it gradually works it way to the first end 102 of the drum. During the course of its travel, the material is repeated lifted and dropped through the gas stream from the exhaust pipe 22. As the stream is in the form of pulses, all of the material is not blown to the closed end of the drum but the dwell time of the material in the dehydrating atmosphere is increased appreciably.

Rotational support for the drum is provided by bearings at the respective ends of the drum, denoted 112 and 114 respectively. A stub axle 116 at the closed end 104 of the drum is received in bearing 112 and the bearing in turn is carried by a support frame 118. A motor 120 on the frame drives the drum rotationally by way of a chain and sprocket drive generally indicated at 122.

At the opposite end of the drum, the bearing 114 rotationally supports a sleeve 126 through which the exhaust pipe 22 and shroud 28 extend. Sleeve 126 is coupled to the cylindrical wall of the drum by a series of radial spokes 128 which are connected to the wall of the drum by brackets 130. Thus, material leaving the drum passes between the spokes and into a stationary collecting hood or chamber 132 forming the material outlet **26*a*** referred to previously.

Duct 34 extends vertically upwards from hood 132 to the cyclone separator 36. Light particles are carried by the gas stream in duct 34 into separator 36 while heavy moist particles remain in suspension until they are dry enough to be carried to the cyclone separator.

Separator 36 is essentially of conventional form. It includes a cyclone chamber 134 having a tangential inlet 136 which is coupled to duct 34 for receiving the gas stream from drum 26. Suspended materials are separated from the gas stream by the swirling action of gases within chamber 134 as is well known in the art and the dried material falls into a hopper 138 and leaves through a dried material outlet 140 at the lower end of the hopper. The gas stream on the other hand is taken off upwardly to an outlet 142. A blower 144 on the outlet assists removal of the gas stream from the cyclone separator. The blower is designed to have sufficient capacity to maintain a slight negative pressure in the system so as to eliminate dust leaks at mating surfaces.

The apparatus provided by the invention has been found adequate to dehydrate agglomerative, fibrous or cellular material in slurry or solid form. FIG. 1 of the drawings shows a hopper 32 for introducing material to be dehydrated. In practice, a pump or screw conveyor may be used to inject the material directly into the exhaust pipe at a rate appropriate to the amount of moisture to be removed. In practical tests, the material feed motor speed was modulated by a temperature sensor located at the material outlet 32 from the rotary drum. The outlet gas temperature was held to within +2 deg. F by controlling the material flow rate with a constant rate of heat input.

It should of course be understood that the preceding description relates to a particular preferred embodiment and that many modifications are possible within the broad scope of the invention. For example, as indicated previously, the pulse combustor of the apparatus can be used other than from material processing, or for different types of material processing. Conversely, a different pulse combustor could be used with the other components from the dehydrator shown in FIG. 1.

I claim:

1. Pulse combustion dehydration apparatus comprising:

a pulse combustor including a combustion chamber and an elongate exhaust pipe forming a reasonate system with the combustion chamber, the exhaust pipe having an inlet for material to be dehydrated and an outlet through which the material is discharged in a pursating exhaust gas stream when the combustor is in operation;

a motor driven rotary drum having a first end into which said exhaust pipe extends, and a second, closed end, the drum extending about a rotary axis and being positioned with said axis inclined upwardly toward said closed end so that material introduced into the drum from said exhaust pipe is directed toward said closed end but tends to return towards said first end of the drum under the effect of gravity, the drum being provided internally with mechanical means for assisting said return of the material and the drum having a material outlet at said first end;

a cyclone separator including a cyclone chamber having an inlet for receiving a gas stream containing suspended material, and in which said gas stream and material are separated, a dried material outlet at a lower end of said chamber, and a gas stream outlet, said inlet of the cyclone chamber being positioned above the material outlet from said rotary drum; and, duct means extending upwardly from said material outlet to said cyclone chamber inlet.

2. A dehydrator as claimed in claim 1, wherein said mechanical means provided internally of the drum comprise a series of flights disposed on an internal wall of the drum for repeatedly lifting and dropping material within the drum as the drum rotates in use, and wherein the drum is provided adjacent said closed end with means for preventing accumulation of material adjacent said end of the drum.

3. A apparatus as claimed in claim 1, further comprising:

low pressure fuel gas supply means including a gas cushion chamber having an inlet provided with a metering orifice and an outlet;

means for admitting fuel charges to said combustion chamber comprising: a fuel gas distributor disposed within the combustion chamber and defining an annular combustion air passageway around the distributor, the distributor having a fuel inlet connected to said outlet of the gas cushion chamber and a plurality of discrete fuel gas outlets from which individual gas streams issue into said combustion chamber when the apparatus is in operation; pressure responsive valve means controlling communication between said fuel inlet and said gas outlets so that the flow of gas to said outlets is interrupted during high pressure portions of the pulse combustion cycle; and pressure responsive valve means for admitting air to said combustion air passageway during low pressure portions of the pulse combustion cycle; and an annular flame trap extending across said annular combustion air passageway upstream of the full gas outlets of the distributor, said flame trap being adapted to provide a relatively smooth, unturbulated flow of air into the combustion chamber.

4. An apparatus as claim in claim 3, wherein the exhaust pipe includes and inner portion adjacent said combustion chamber of a first diameter and an outer portion adjacent said inner portion of increased diameter, and wherein the apparatus further includes a fluid inlet in said outer potion of the exhaust pipe at a location adjacent said inner portion of the pipe for permitting a fluid to be drawn into the pipe during low pressure portions of the combustion cycle.

5. An apparatus as claimed in claim 4, further comprising an air cushion chamber for combustion air communicating with said combustion chamber inlet means, and an air bypass pipe extending between said air cushion chamber and said fluid inlet to the exhaust pipe, whereby air from the air cushion chamber is drawn into the exhaust pipe during said low pressure portions of the pulse combustion cycle.

6. An apparatus as claimed in claim 5, wherein said fluid inlet is located approximately at the center of the length of the exhaust pipe and wherein said air bypass pipe is of a length approximately equal to one half of the overall length of the exhaust pipe.

7. An apparatus as claimed in claim 4, for material processing, wherein the exhaust pipe is provided in said outer potion with an inlet for material to be dehydrated, said inlet being positioned so that gases flowing from said inner portion to said outer portion of the exhaust pipe cause an injector action at said material inlet.

8. An apparatus as claim in claim 3 wherein said fuel distributor of a cylindrical shape and wherein said gas outlets are defined by radial openings into a cylindrical outer surface of the distributor, said flame trap extending around said cylindrical surface upstream of said fuel gas outlets.

* * * * *